US005145427A

United States Patent [19]

Kawai et al.

[11] Patent Number: 5,145,427

[45] Date of Patent: Sep. 8, 1992

[54] STEERING MECHANISM FOR OUTBOARD MOTOR

[75] Inventors: Takaji Kawai; Kouji Abe, both of Hamamatsu, Japan

[73] Assignee: Sanshin Kogyo Kabushiki Kaisha, Hamamatsu, Japan

[21] Appl. No.: 665,328

[22] Filed: Mar. 5, 1991

[30] Foreign Application Priority Data

Mar. 6, 1990 [JP] Japan ..... 2-54695

[51] Int. Cl.[5] ..... B63H 21/30

[52] U.S. Cl. ..... 440/52; 440/900

[58] Field of Search ..... 440/52, 111, 900; 248/634, 635, 636, 637, 638, 639, 640, 641, 642, 643, 231.9, 231.91; 267/141.2; 411/75, 80

[56] References Cited

U.S. PATENT DOCUMENTS

| | | | |
|---|---|---|---|
| 1,689,032 | 10/1928 | Johnson | 440/52 |
| 1,999,694 | 4/1935 | Irgens | 440/52 |
| 2,478,858 | 8/1949 | Buske | 440/52 |
| 2,488,199 | 11/1949 | Jordan | 440/52 |
| 2,585,774 | 2/1952 | Heidner et al. | 440/52 |
| 2,740,368 | 4/1956 | Irgens et al. | 440/52 |
| 4,979,918 | 12/1990 | Breckenfeld et al. | 440/52 |

FOREIGN PATENT DOCUMENTS 1-43999 12/1989 Japan .

*Primary Examiner*—Jesus D. Sotelo
*Assistant Examiner*—Stephen P. Avila
*Attorney, Agent, or Firm*—Ernest A. Beutler

[57] ABSTRACT

A steering mechanism for an outboard motor which comprises a steering bracket having a mounting bore and a steering handle having a mounting shaft at one end that is received for pivotal rotation within the mounting bore. In one embodiment, a wave washer is positioned within a counterbore formed at the upper end of the mounting bore and coaxial therewith so that the wave washer is between the steering bracket and the steering handle. In another embodiment, a pair of rubber members are each positioned within one of a pair of counterbores that are coaxial with the mounting bore, one being formed at the upper end of the mounting bore and the other being formed at the lower end, so that the rubber members are interposed between the steering bracket and the steering handle. The wave washer and rubber members dampen vibration transmission between the steering bracket and handle, and permit pivotal adjustment of the handle up or down while still providing sufficient frictional resistance against inadvertent pivotal movement of the handle. An area of rigid contact is positioned radially outward of the upper counterbore between the steering handle and the steering bracket to provide a highly responsive steering mechanism.

14 Claims, 4 Drawing Sheets

STEERING MECHANISM FOR OUTBOARD MOTOR

BACKGROUND OF THE INVENTION

This invention relates to a steering mechanism for an outboard motor, and more particularly to an improved steering mechanism and mounting structure for a steering handle of an outboard motor, which is highly responsive, which minimizes steering handle vibrations during operation, and which provides sufficient frictional resistance to prevent vertical swinging of the steering handle once it has been pivotally adjusted to a desired position.

As is well known, a common form of outboard motor consists of a driveshaft housing that carries a driveshaft which is driven by an internal combustion engine and which drives a propeller for propelling an associated watercraft through the water. The driveshaft housing normally has a steering shaft affixed to it that is journaled within a swivel bracket for steering movement about a generally vertically extending steering axis. The swivel bracket is, in turn, pivotally connected to the transom of the watercraft for tilting and trimming movement of the driveshaft housing about a generally horizontally extending axis.

In order to effect steering of the watercraft, a steering handle is affixed at one end to a steering bracket which, in turn, is mounted to the driveshaft housing so that an operator may steer the outboard motor from within the watercraft by moving the other end of the steering handle from side to side. It has also been the practice with some outboard motors to mount the steering handle on the steering bracket for pivotal movement about a generally horizontally extending axis so as to permit vertical adjustment. With prior constructions of this type, the steering handle is mounted indirectly to the steering bracket through an elastic member which is interposed between the steering bracket and handle so that the vibration from the engine is not transmitted to the steering handle and so that the steering handle may be maintained at a desired vertical position by frictional resistance after it is pivoted up or down. Although such an arrangement has certain advantages, it also has certain disadvantages associated with it as well. For example, since there is no area of rigid contact between the steering handle and bracket, the force exerted on the steering handle in steering the watercraft is transmitted to the steering bracket through the elastic member. As a result, the steering handle is likely to exhibit some "play" during steering of the watercraft which reduces the responsiveness of the steering operation. Also, under some conditions, repeated steering movement tends to wear the elastic member. This wear may reduce the effectiveness of the steering mechanism and may render the insulator member unable to prevent vibration transmission from the engine to the handle.

It is, therefore, a principal object of this invention to eliminate or reduce the above disadvantages.

It is a further object of this invention to provide a steering mechanism and mounting structure for an outboard motor which is highly responsive to the operator's steering movements but wherein steering handle vibration is minimized.

It is yet another object of this invention to provide a highly responsive steering mechanism and mounting structure for an outboard motor which permits pivotal vertical adjustment of the steering handle but which provides sufficient frictional resistance against inadvertent vertical swinging of steering handle once the handle has been adjusted to a desired position.

SUMMARY OF THE INVENTION

This invention is adapted to be embodied in a steering mechanism for an outboard motor. The steering mechanism comprises a steering bracket having a mounting bore and a steering handle having a mounting shaft at one end which is received for pivotal rotation within the mounting bore. The steering mechanism further includes means for dampening vibration transmission between the steering bracket and the steering handle. In accordance with the invention, an area of rigid contact is provided between the steering handle and the steering bracket located adjacent to the vibration dampening means.

In a first embodiment of the invention, the vibration dampening means comprises a wave washer.

In a second embodiment, the vibration dampening means comprises at least one rubber member.

DETAILED DESCRIPTION OF THE PREFERRED EMBODIMENTS OF THE INVENTION

Figure 1:
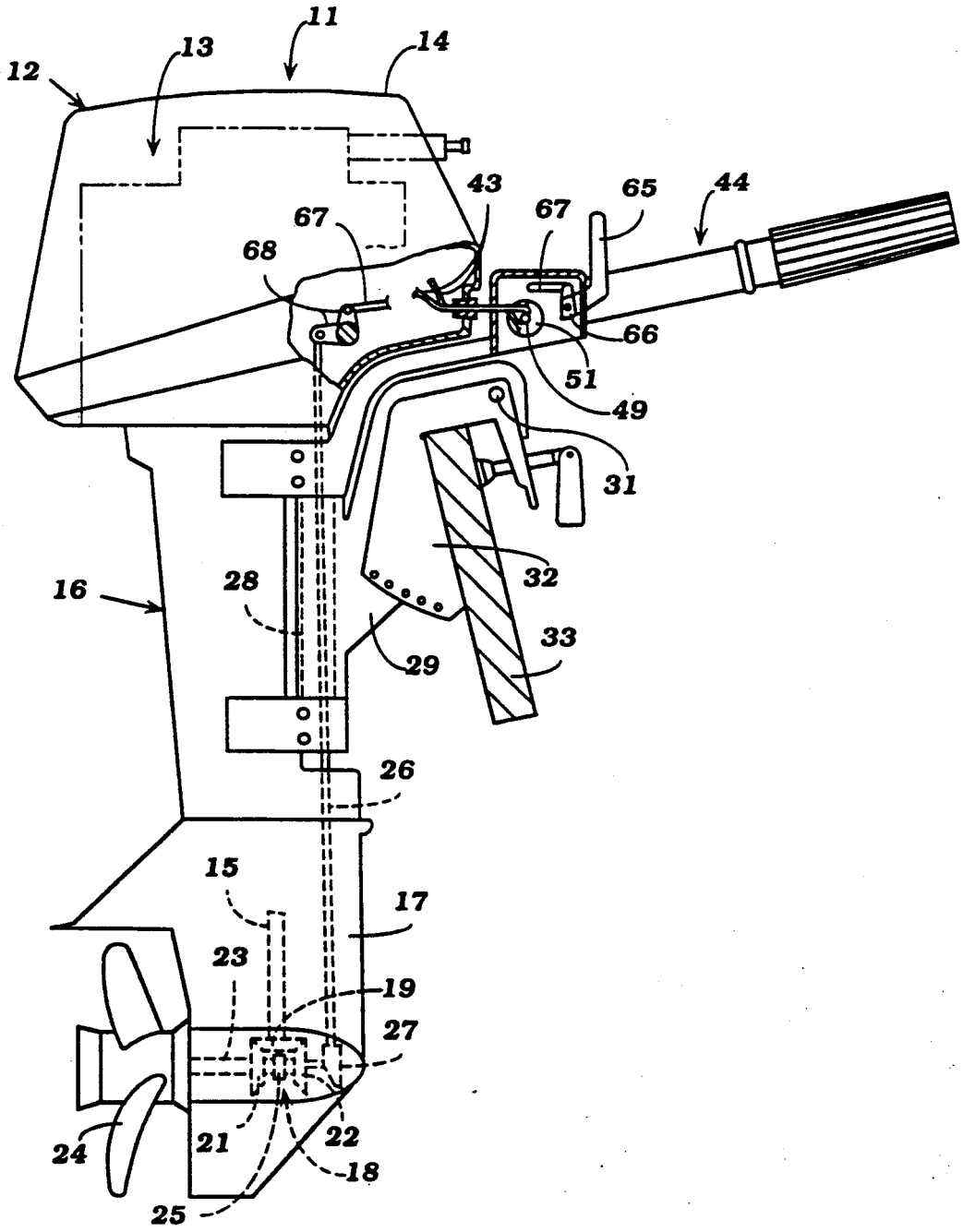
FIG. 1 is a side elevational view of an outboard motor constructed in accordance with an embodiment of the invention, with portions broken away and other portions shown in cross section.

Referring first to FIG. 1, an outboard constructed in accordance with an embodiment of the invention is identified generally by the reference numeral 11. The outboard motor 11 includes a power head, indicated generally by the reference numeral 12, and which is comprised of a powering internal combustion engine 13 that is surrounded by a protective cowling 14. A driveshaft 15 is driven by the output shaft of the engine 13 and is rotatably journaled within a driveshaft housing 16 that depends from the power head 12.

The driveshaft 15 extends through a lower unit 17 that depends from the driveshaft housing 16 and has affixed to its lower end a driving bevel gear 19 of a forward, neutral, reverse transmission, indicated generally by the reference numeral 18. This transmission 18 includes a pair of counter-rotating bevel gears 21 and 22 that are in mesh with the driving bevel gear 19 on diametrically opposite sides. As such, the bevel gears 21 and 22 will be continuously driven in opposite directions.

The bevel gears 21 and 22 are journaled upon a propeller shaft 23 which is, in turn, journaled in a known manner within the lower unit 17. A propeller 24 is affixed to the propeller shaft 23 for rotation with it. A dog clutching sleeve 25 is disposed between the bevel gears 21 and 22 and is splined for rotation with the propeller shaft 23. The dog clutching sleeve 25 is adapted to be slid axially into engagement with cooperating dog clutch elements formed on the gears 21 and 22 so as to rotatably couple one of these gears 21 or 22 for rotation with the propeller shaft 23 so as to drive the propeller 24 in selected forward or reverse directions. A shift rod 26 is supported within the driveshaft housing 16 and lower unit 17 and operates the dog clutching sleeve 25 by means of a cam member 27, as hereinafter described.

A steering shaft 28 is affixed to the driveshaft housing 16 and is journaled within a swivel bracket 29 for steering of the outboard motor 11 about a generally vertically extending steering axis, as hereinafter described. The swivel bracket 29 is, in turn, pivotally supported by means of a tilt shaft 31 and clamp bracket 32 for tilting and trimming movement of the outboard motor 11 about a generally horizontally extending tilt axis defined by the tilt shaft 31. The clamp bracket 32 is provided with a clamp so as to afford a detachable connection to a transom 33 of an associated watercraft.

Figure 2:
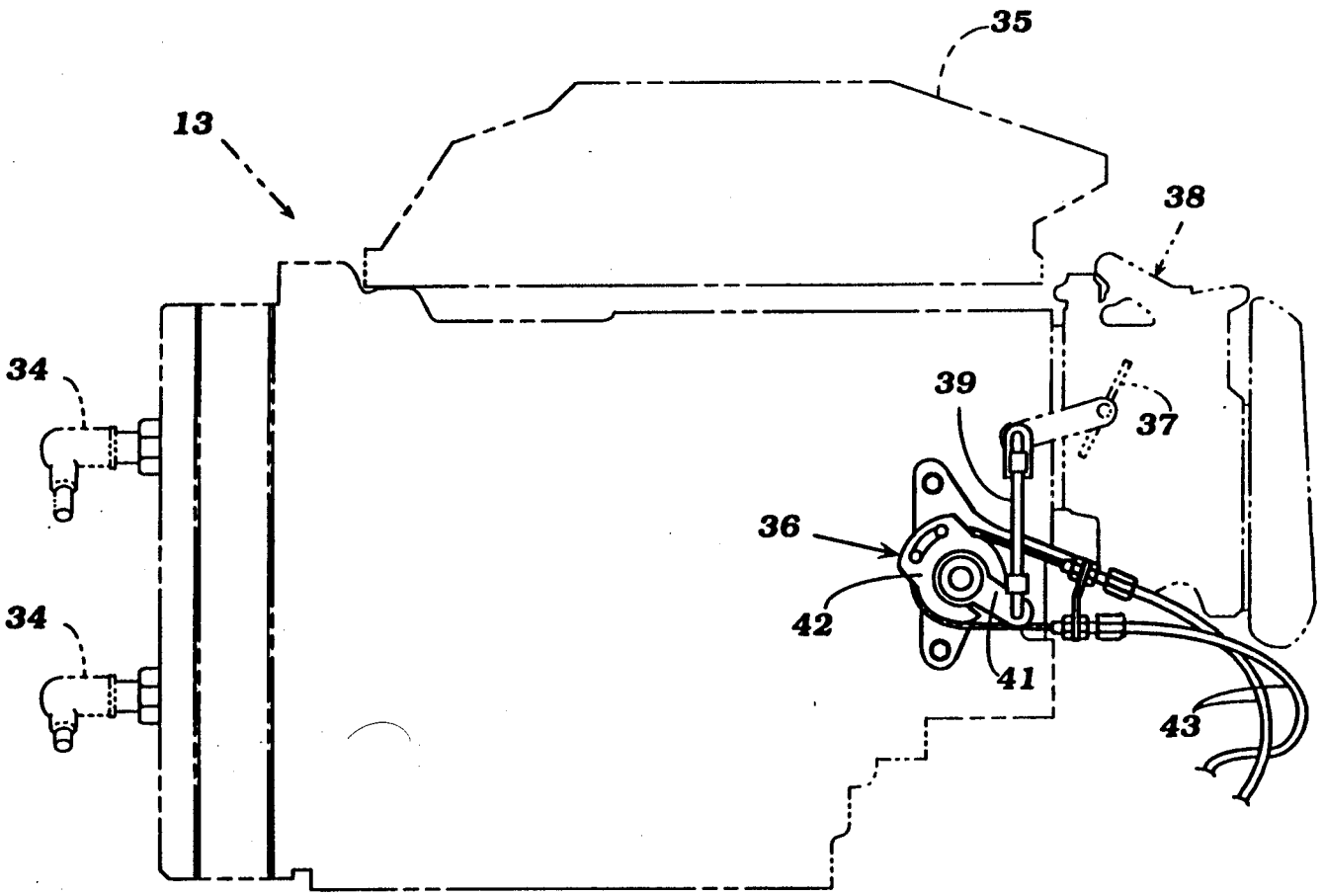
FIG. 2 is an enlarged side elevational view showing the outboard motor engine and its throttle linkage system.

Referring now to FIG. 2 in addition to FIG. 1, it will be seen that the engine 13 is provided with spark plugs 34, one for each cylinder of the engine 13. These spark plugs 34 are fired in a known manner by means of an ignition system which includes a magneto generator, identified by the reference numeral 35.

A throttle actuating mechanism 36 is provided for controlling the position of a throttle valve 37 of each carburetor 38, and thereby for controlling the speed of the engine 13. Each throttle valve 37 is affixed for pivotal movement on an associated support shaft within one of the carburetors 38. A throttle lever is associated with each throttle valve 37 and is connected at one end to the support shaft and at the other end to a link 39 which interconnects each throttle lever with an arm 41 of an actuating disc 42. This actuating disc 42 is rotatably mounted on the side of the engine 13 and has a pair of grooves extending along its outer perimeter for accommodating the inner wires of a pair of throttle cables 43, the outer wires of which are affixed to the engine 13 by means of a mount. One end of each of these inner wires is engaged with a slot in the actuator disc 42 opposite the arm 41 for rotatably actuating the disc 42 in a manner to be described. Rotation of the disc 42, in turn, effects generally linear movement of the link 39 which causes each throttle lever to pivot along with the support shaft to actuate the associated throttle valve 37.

Figure 3:
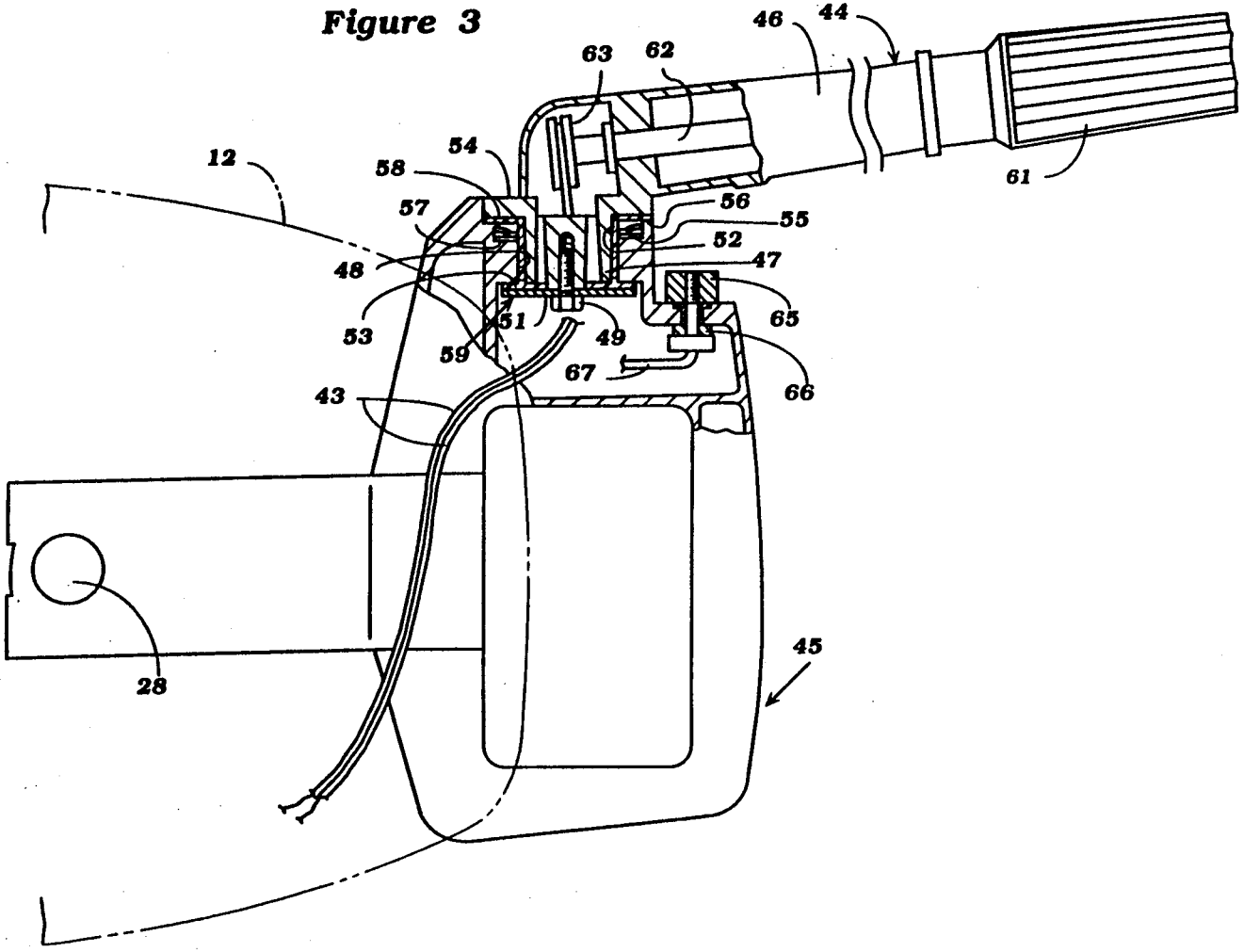
FIG. 3 is an enlarged top plan view of a first embodiment of the steering mechanism and mounting structure, with portions broken away and other portions shown in cross section.

Referring now to FIG. 3, as well as FIG. 1, a first embodiment of a steering mechanism for the outboard motor 11 is illustrated. This steering mechanism includes a steering handle 44 which is coupled to the driveshaft housing 16 through a steering bracket 45 for effecting operator controlled steering movement of the driveshaft housing 16 about a steering axis defined by the steering shaft 28, and thereby for effecting steering of the outboard motor 11 and associated watercraft.

The steering handle 44 is comprised of a body member 46 having a mounting shaft 47 at one end which extends in a generally perpendicular direction to the remainder of the body 46. This mounting shaft 47 is rotatably received within a mounting bore 48 of the steering bracket 45 and retained within the mounting bore 48 by means of a bolt 49 and mounting cover 51 which is secured across the lower end of the mounting shaft 47 and which has a greater diameter than that of the mounting bore 48. As shown in FIG. 3, a bushing 52 is interposed between the mounting shaft 47 and the mounting bore 48. The bushing 52 also has an upper segment lined between the inner side of a flange 54 of the steering handle body 46 and the steering bracket 45. A gasket 53 is positioned between an inner portion of the steering bracket 45 and the mounting cover 51.

A counterbore 55 is formed in the upper end of mounting bore 48 and is coaxial therewith but has a greater diameter than bore 48 for accommodating a wave washer 56. As such, this wave washer 56 is seated directly on a base portion 57 of the counterbore 55 and encircles the mounting shaft 48 and the portion of the bushing 52 lining the shaft 48. The upper side of the wave washer 56 bears against the upper portion of the bushing 52 which, in turn, bears against the inner side of the flange 54. With this arrangement, the wave washer 56 acts to dampen vibration transmission of the engine 13 between the steering bracket 45 and the steering handle 44. The wave washer 56 also permits the operator to pivotally adjust the steering handle 44 up or down relative to the steering bracket 45 while still providing a sufficient frictional force between the bracket 45 and handle 44 so as to hold the handle 44 in a desired pivot position and to prevent inadvertent pivotal movement of the handle 44 under normal conditions.

Figure 4:
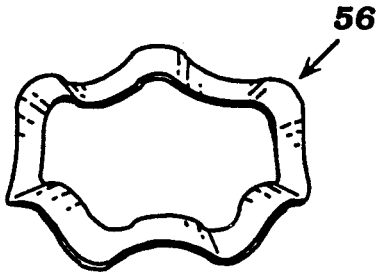
FIG. 4 is a plan view of a wave washer of the steering mechanism.

The structure of the wave washer 56 is illustrated in FIG. 4. In accordance with the invention, this wave washer 56 is constructed out of material having elasticity and insulating properties.

The flange 54 of the steering handle body 46 is formed around the upper end of the mounting shaft 47 and is positioned over the upper segment of the bushing 52 at the outer end of the counterbore 55. In accordance with the invention, the flange 54 has a diameter larger than that of the counterbore 55. This portion of the flange 54, which is positioned radially outward of the counterbore 55, is identified by the reference numeral 58 and provides an area of rigid contact between the steering handle 44 and the steering bracket 45 through the bushing 52 so as to provide a highly responsive steering mechanism. A second contact portion is identified by the reference numeral 59 and includes the area of overlap between the mounting cover 51, lower segment of the bushing 53 and inner portion of the steering bracket 45. This second contact portion 59 also cooperates in providing a highly responsive steering mechanism.

The steering handle 44 is also equipped with a grip/throttle actuator 61 which is rotatably supported on the end of the steering handle body 46 opposite the mounting shaft 47. A shaft 62 is rotatably journaled within the steering handle body 46 and is affixed at one end to the throttle actuator 61 for rotation therewith. A disc member 63 is connected to the other end of the shaft 62 and is provided with circumferential grooves which are adapted to accommodate the inner wires of the throttle cables 43. With this arrangement, the position of the throttle valve 37 can be controlled using the throttle actuator 61.

In addition to the throttle actuator 61, the steering mechanism is also provided with a shift lever 65 which is pivotally mounted at one end on the steering bracket 45 in proximity to the handle 44 for shifting the transmission between the neutral, forward and reverse positions. An associated link 66 is also pivotally mounted at one end about the same axis as the shift lever 65 for movement with the lever 65. Shift cables 67 interconnect the other end of link 66 with one of a pair of links 68 that are pivotally secured about a common axis on the power head 12 rearwardly of the link 66. These links 68 extend generally at a right angle to one another and are adapted to pivot as a unit. The other one of the links 68 is connected to the shift rod 26 at its end opposite its pivot point. With this arrangement, movement of the shift lever 65 and associated link 66 effects a pushing-pulling movement of the shift cables 67 to cause the links 68 to rotate about their pivot point. This, in turn, causes the shift rod 26 to move up or down to actuate the cam member 27 which is operatively connected to the dog clutching sleeve 25. Accordingly, actuation of the cam member 27 causes the dog clutching sleeve 25 to be slid axially between a neutral position wherein it is not engaged and forward and reverse positions wherein the sleeve 25 is engaged with the dog clutch element on either gear 21 or 22.

Figure 5:
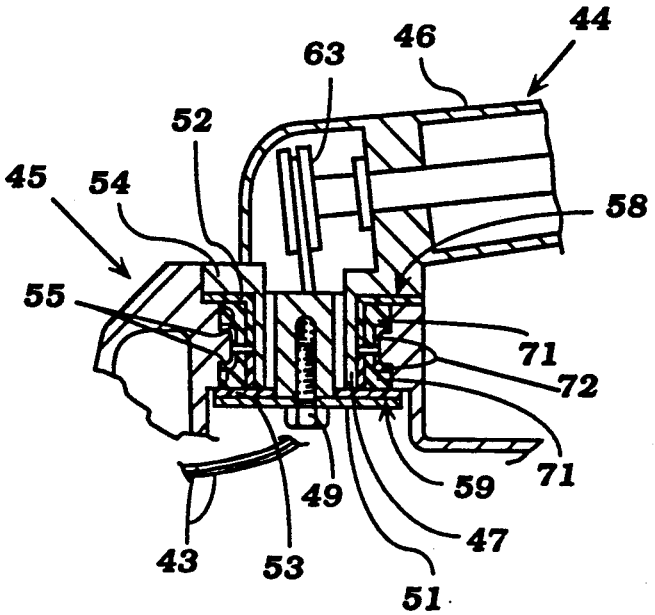
FIG. 5 is an enlarged cross sectional view of the steering mechanism and mounting structure, showing a second embodiment of the invention.

A second embodiment of the steering mechanism is depicted in FIG. 5. This steering mechanism of the second embodiment is generally similar to the steering mechanism described in connection with the first embodiment and, for that reason, components of this second embodiment which are the same as components of the first embodiment are identified by the same reference numerals and will not be described again, except insofar as is necessary to understand the construction and operation of this second embodiment.

In this second embodiment, a pair of counterbores 55 are formed in the mounting bore 48, one at the upper end of the mounting bore 48 and the other at its lower end. Each of these counterbores 55 is coaxial with the mounting bore 48 but has a greater diameter than bore 48 for accommodating a rubber member 71. The rubber members 71 are positioned in the counterbores 55 around the mounting shaft 48 and the portion of the bushing 52 lining the shaft 48. The upper side of each rubber member 71 bears against the upper portion of the bushing 52 which, in turn, bears against the inner side of the flange 54. The lower side of each rubber member 71 is in contact with the gasket 53 which is inside of the mounting cover 51. There is associated with each rubber member 71 a gasket 72 positioned between the corresponding rubber member 71 and the steering bracket 45. With this arrangement, the rubber members 71 serve to dampen vibration transmission of the engine 13 between the steering bracket 45 and the steering handle 44. As is the case in the first embodiment, this construction also permits the operator to pivot the handle 44 up or down relative to the steering bracket 45 while still providing a sufficient frictional force between the bracket 45 and handle 44 so as to hold the handle 44 in a desired pivot position and to prevent unintended pivotal movement of the handle 44 under normal conditions.

It should be readily apparent from the foregoing description that two embodiments of a steering mechanism including a steering handle are provided both of which are highly responsive to the operator's steering movements but which permit the steering handle to be pivotally adjusted up or down to suit the operator. In addition, the steering mechanism of each embodiment is constructed to provide sufficient frictional resistance so as to maintain the steering handle in the desired pivot position under normal conditions until the operator decides to reposition the handle. Although this is the case, the foregoing description is that of preferred embodiments of the invention, and various changes and modifications may be made without departing from the spirit and scope of the invention, as defined by the appended claims.

We claim:

1. A steering mechanism for an outboard motor comprising a steering bracket having a mounting bore, a steering handle having a mounting shaft at one end which is received for pivotal rotation within the mounting bore of said steering bracket for adjustment of said steering handle in a generally vertical direction, means for dampening vibration transmission between said steering bracket and said steering handle and for holding said steering handle at one of a plurality of vertically adjusted pivot positions, and an area of rigid contact between said steering handle and said steering bracket located adjacent to and surrounding said vibration dampening means.

2. A steering mechanism as recited in claim 1, wherein said steering bracket has a counterbore, for accommodating said vibration dampening means, in at least one end of said mounting bore, the diameter of said counterbore being greater than the diameter of said mounting bore.

3. A steering mechanism as recited in claim 2, wherein said mounting shaft includes a flange formed around an upper end of said mounting shaft and having a diameter greater than the diameter of said counterbore such that a portion of said flange is positioned radially outward of said counterbore.

4. A steering mechanism for an outboard motor comprising a steering bracket having a mounting bore and a counterbore in at least one end of said mounting bore, the diameter of said counterbore being greater than the diameter of said mounting bore, a steering handle having a mounting shaft at one end which is received for pivotal rotation within the mounting bore of said steering bracket, said mounting shaft including a flange formed around an upper end of said mounting shaft and having a diameter greater than the diameter of said counterbore such that a portion of said flange is positioned radially outward of said counterbore, means for dampening vibration transmission between said steering bracket and said steering handle accommodated in said counterbore, and an area of rigid contact between said steering handle and said steering bracket located adjacent to said vibration dampening means, wherein said area of rigid contact between said steering handle and said steering bracket comprises said flange portion positioned radially outward of said counterbore.

5. A steering mechanism as recited in claim 4, further comprising a bushing interposed between said mounting shaft and said mounting bore.

6. A steering mechanism as recited in claim 5, further comprising a mounting cover secured across a lower end of said mounting shaft, the diameter of said mounting cover being greater than the diameter of said mounting bore.

7. A steering mechanism as recited in claim 1, wherein said vibration dampening means comprises a wave washer.

8. A steering mechanism as recited in claim 1, wherein said vibration dampening means comprises at least one rubber member.

9. A steering mechanism for an outboard motor comprising a steering bracket having a mounting bore, a steering handle having a mounting shaft at one end which is received for pivotal rotation within the mounting bore of said steering bracket, means for dampening vibration transmission between said steering bracket and said steering handle, and an area of rigid contact between said steering handle and said steering bracket located adjacent to said vibration dampening means, wherein said steering bracket has a pair of counterbores, for accommodating said vibration dampening means, one in an upper end of said mounting bore and the other in a lower end of said mounting bore, the diameter of said counterbores being greater than the diameter of said mounting bore.

10. A steering mechanism as recited in claim 9, wherein said mounting shaft includes a flange formed around an upper end of said mounting shaft and having a diameter greater than the diameter of said upper counterbore such that a portion of said flange is positioned radially outward of said upper counterbore.

11. A steering mechanism as recited in claim 10, wherein said area of rigid contact between said steering handle and said steering bracket comprises said flange portion positioned radially outward of said upper counterbore.

12. A steering mechanism as recited in claim 11, further comprising a bushing interposed between said mounting shaft and said mounting bore.

13. A steering mechanism as recited in claim 12, further comprising a mounting cover secured across a lower end of said mounting shaft, the diameter of said mounting cover being greater than the diameter of said mounting bore.

14. A steering mechanism as recited in claim 9, wherein said vibration dampening means comprises a pair of rubber members, one positioned in each of said counterbores.

* * * * *